US008033746B2

(12) United States Patent
Tsai

(10) Patent No.: US 8,033,746 B2
(45) Date of Patent: Oct. 11, 2011

(54) ELECTRICALLY-DRIVEN POWER COSMETICS APPLICATION DEVICE

(76) Inventor: Yi-Li Tsai, Taichung (TW)

( * ) Notice: Subject to any disclaimer, the term of this patent is extended or adjusted under 35 U.S.C. 154(b) by 329 days.

(21) Appl. No.: 12/477,931

(22) Filed: Jun. 4, 2009

(65) Prior Publication Data

US 2010/0310298 A1 Dec. 9, 2010

(51) Int. Cl.
*B47K 7/12* (2006.01)

(52) U.S. Cl. ..... 401/117

(58) Field of Classification Search ..... 401/117, 401/115, 107, 99, 288, 286
See application file for complete search history.

(56) References Cited

U.S. PATENT DOCUMENTS 5,339,483 A * 8/1994 Byun ..... 15/184
6,234,181 B1 * 5/2001 Lou ..... 132/313
7,275,885 B2 * 10/2007 Byun ..... 401/280
* cited by examiner

*Primary Examiner* — Huyen Le
(74) *Attorney, Agent, or Firm* — Leong C. Lei

(57) ABSTRACT

An electrically driven powder cosmetics application device is controlled by high speed operation of a motor together with an eccentric weight block to induce vibration for facilitating uniform dispensing of powder cosmetics. The device includes a plastic container having an end forming a powder dispensing port containing therein a filter. Provided outside the dispensing port is a hollow collar fit over a dispensing device including a brush and a brush hair confiner tube with a powder outlet passage arranged therein. An opposite end of the container has a bottom receiving therein a vibration device including a rotation motor and an eccentric weight and a battery set for supplying electrical power and controlled by a switch to turn on/off vibration operation. With the vibration device turned on, the container is provided with assistance for dispensing cosmetics thereby ensuring uniform and smooth dispensing of the powder cosmetics contained in the container.

5 Claims, 3 Drawing Sheets

ELECTRICALLY-DRIVEN POWER COSMETICS APPLICATION DEVICE

TECHNICAL FIELD OF THE INVENTION

The present invention generally relates to electrically driven application of powder cosmetics, wherein an end of a powder cosmetic container forms a powder dispensing port that contains therein a filter and has a powder outlet passage extending to an inner bottom of a dispensing device, an opposite end of the container receiving therein a rotation motor driving and controlling an eccentric weight block to cause vibration by rotation control so as to ensure smooth discharge of powder cosmetics by means of vibration, whereby uniform and quantitative dispensing of powder cosmetics can be effectively facilitated to make makeup operations with powder cosmetics suiting practical needs.

DESCRIPTION OF THE PRIOR ART

A conventional cosmetics dispensing device for powder cosmetics, such as dispensing devices for regular cosmetic powders and baby powders, can be found in patent gazette and daily living articles, and generally comprises a container which is filled with powder cosmetics and has a top end forming a discharge port to which a dispensing head that forms perforations or a commonly seen cosmetics dispensing head composed of brush hair bundles. A cover is then put on the outside for closure so as to cover the dispensing head. In this way, a complete package and covering for safety for powder cosmetics is provided. However, for the dispensing end being made either a curved bundle-like brush or a perforated surface for dispensing of powders, the purposes are to uniformly dispense cosmetic powder for use. To use, the enclosing cover is removed and the container is reversed or inclined to an angle for pouring the powder out. These conventional dispensing packaging often needs assistance of force application by a user hand flapping or shaking it in order to cause the internally deposited powder cosmetics to dispense outward. In view of this way of application, definitely, no uniform dispensing can be realized for the dispensing process is determined by the magnitude of the force applied and the inclined pouring angle. Uniform dispensing can hardly be realized especially for over-tiny powders and in case of oxidation and aggregation of the powders. Thus, it needs skilled shaking and control, plus proper application of force, to make it possible to smoothly dispense the powder. In doing make up, due to the unsmooth and non-uniform powder dispensing, the powders may not be directly and uniformly applied to a desired site. This not only causes a waste of time but also requires repeated application to achieve a desired result of make up. Due to the non-uniform and inconvenient dispensing of the powder cosmetics, various packages of powder cosmetics are provided by being filled in containers with wide openings for the purposes of being easy to use a puff or a tiny brush to pick up powder cosmetics after the container is opened. Such a trouble of use is generally due to being hard to control uniform dispensing of the powder cosmetics, which leads to inconvenience in practical use of the cosmetics. In view of the needs of doing make up, it is desired to provide an improvement in the dispensing structure so that assistance of simple and uniform dispensing can be provided to make application of powder cosmetics easy and this certainly needs further development in the industry.

SUMMARY OF THE INVENTION

The present inventor has engaged in the development and research of makeup products and has sold and manufactured makeup products for tens of years and is fully aware of drawbacks of practicability induced in the use of the known cosmetics packaging container. With an attempt to improve the practicability of products and for the purposes of research and development, after numerous times of improvement, the present inventor eventually makes an electrically driven powder cosmetics application device as described in the present invention, wherein an inner bottom of a packaging container of powder cosmetics is provided with a rotation motor for effecting control, which may uses high speed rotation of a weight block to induce minute high frequency vibration, so as to provide assistance of dispensing powder cosmetics through the vibration, which as being operated by turning on/off of a switch, realizes the control of application in a uniform and properly quantitative manner and thus remarkably improve various currently existing drawbacks of practicability in respect of non-uniform dispensing and being hard to control in the use of the powder cosmetics.

A primary objective of the present invention is to provide a cosmetics packaging container having a bottom in which a rotation motor is received to control and rotate a weight block. In rotation, due to the unbalanced distribution of weight, high speed vibration is induced to realize assistance offered by high speed vibration of the container. With the switching control by a switch, when the cosmetics are being dispensed, cosmetic powder can be operated and controlled to uniformly and efficiently dispensed, so as to provide uniform, smooth, and properly quantitative dispensing of cosmetics in doing make up.

The foregoing objective and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
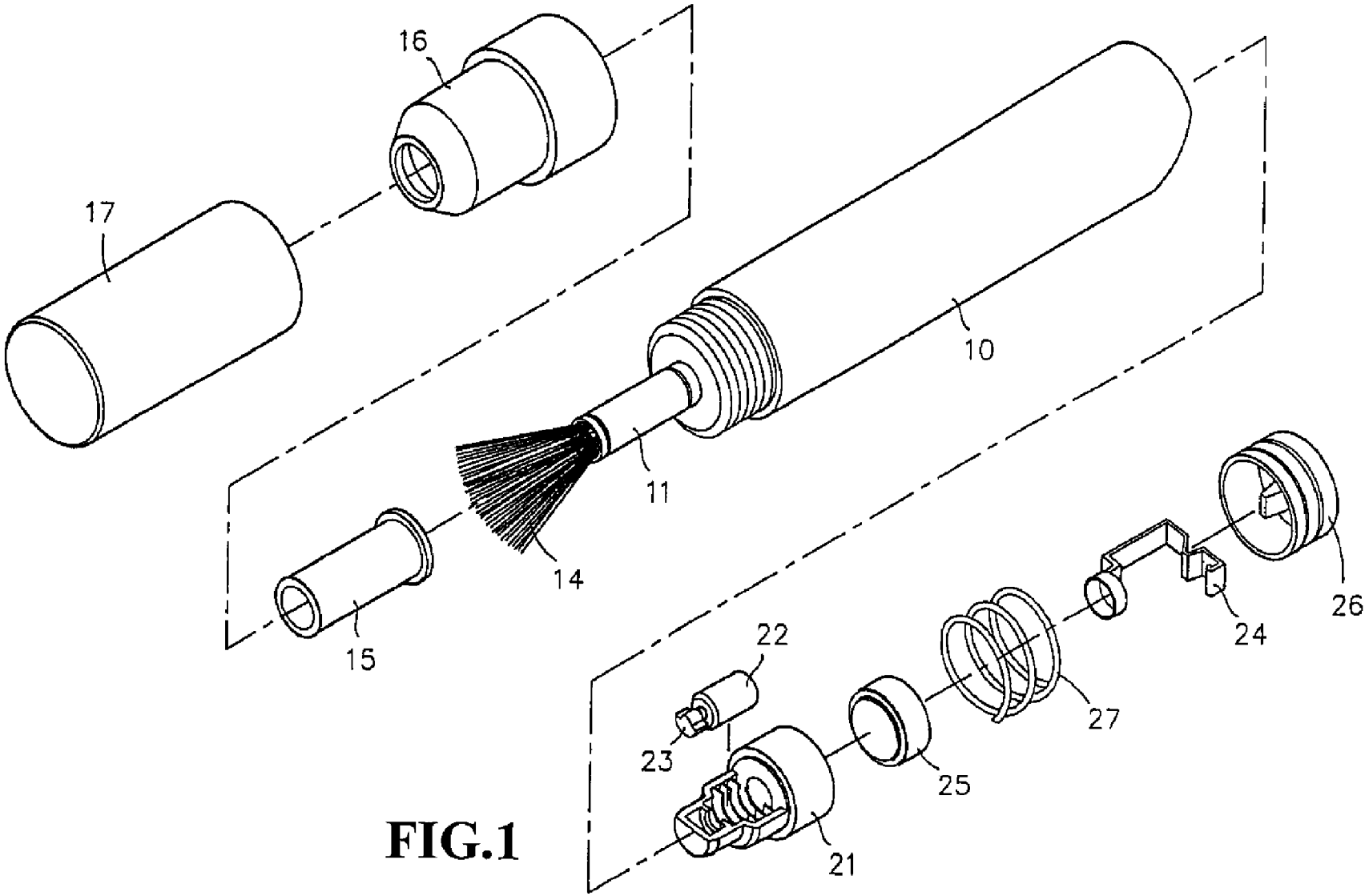
FIG. 1 is an exploded view of a cosmetic container in accordance with the present invention.
Figure 2:
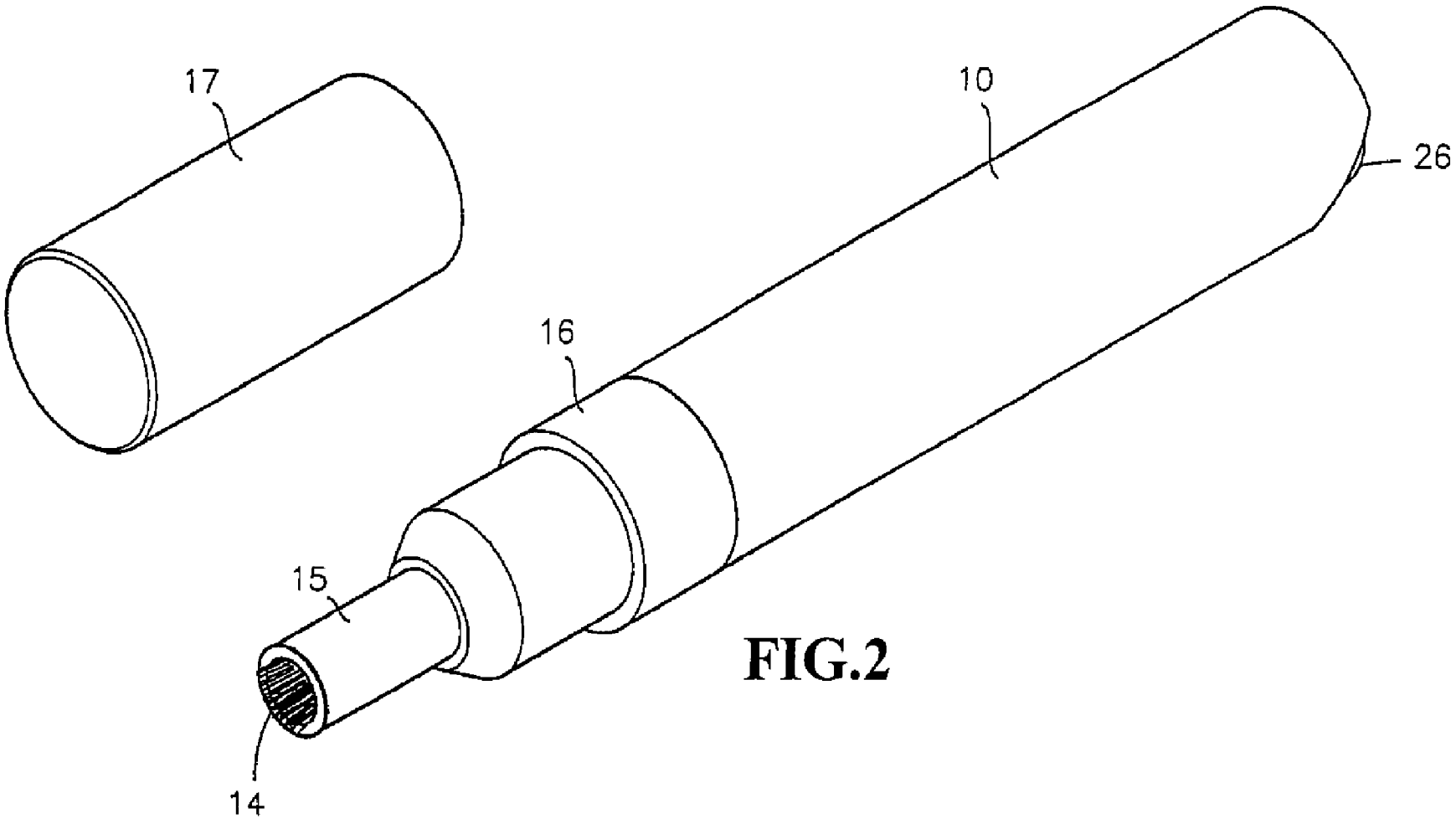
FIG. 2 is a perspective view of the cosmetic container of the present invention.
Figure 3:
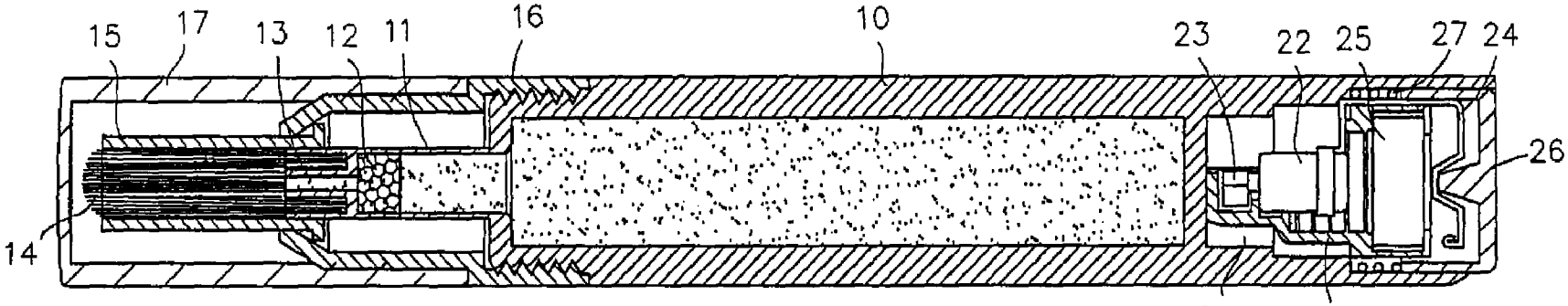
FIG. 3 is a cross-sectional view of the cosmetic container of the present invention in an assembled form.
Figure 4:
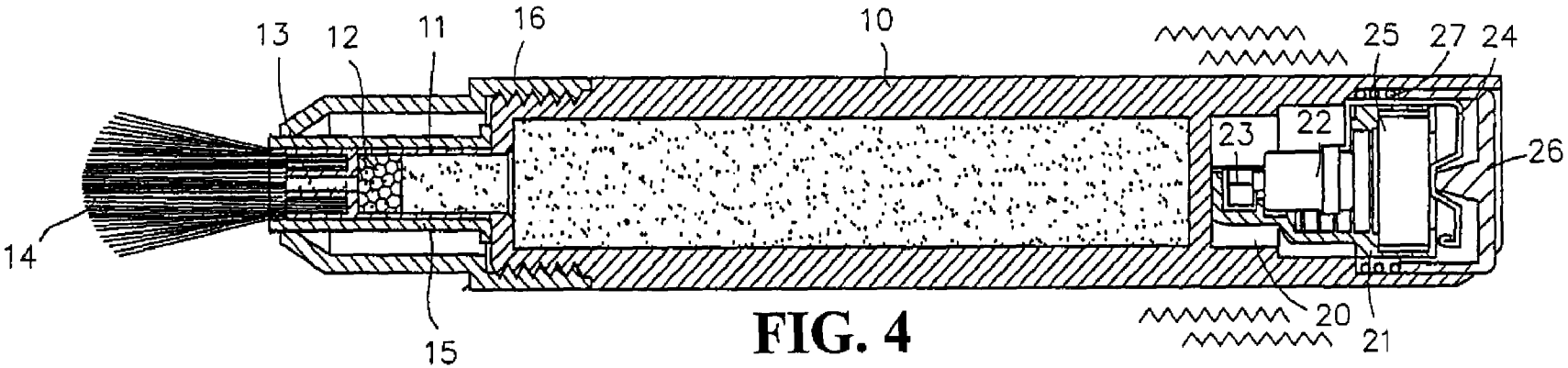
FIG. 4 is a cross-sectional view of the cosmetic container of the present invention, illustrating dispensing of cosmetics by being assisted by vibration.

The present invention provides an electrically-driven powder cosmetics application device, which is particularly shown in FIGS. 1-4. A lash brush is taken as an example to describe the electrically-driven powder cosmetics application device of the present invention. The powder cosmetics application device of the present invention comprises a container 10, which is made in the form of an elongate tubular member for easy hand holding and receiving powder cosmetics. The container 10 is preferably of a diameter of 16-32 mm. The container 10 has an end that is reduced to form a powder dispensing port 11, which is made in the form of an extended tube fit into an end opening of the container 10. The powder dispensing port 11 receives therein a filter 12, which is composed of one or plural blocks of sponges of a suitable length and having properly arranged pores of 2-3 mm diameter to keep the size of dispensed powder and to eliminate aggregated blocks formed by powders bonded together so as to ensure smooth dispensing of powder. The filter 12 forms a tubular section extending from an outer side thereof, which has a central portion defining a slender powder outlet passage 13 extending to an end of the tubular section and a circumferential portion in which a brush 14 is mounted. A slidable brush hair confiner tube 15 is circumferentially fit outside the filter 12 to form a dispensing device. After use, the brush hair confiner tube 15 may use to confine and house the brush 14 for easy storage. The powder outlet passage 13 is configured to extend to a lower portion of the brush 14 to timely supply powder cosmetics to the lower end of the brush 14 to facilitate dispensing of the powder. An outer circumference of the brush hair confiner tube 15 is fit with a hollow collar 16 to be coupled to a top end of the container 10, whereby the brush hair confiner tube 15 may carry out sliding based position control operation in a telescopic manner as being held by the hollow collar 16 and is covered and sealed by a top end cap 17 set at the outside to form a contamination protection device for the brush 14. An opposite end of the container 10 forms a cavity 20 of a desired depth to receive a separate electrics holder 21 directly set therein, primarily functioning to hold a rotation motor 22, which has a spindle extending to the outside to carry a weight block 23 that is formed as an eccentric flywheel; these can be assembled separately and then put into the cavity 20 defined in a bottom of the container 10. The rotation motor 22 is connected by an electric wire or a conductor 24 to a push-control switch 26 for connection with a battery set 25 that supplies electrical power. The battery set 25 can be set outside the electrics holder 21, namely the bottom of the container 10, as being spaced by a simple partition board, and is retained by the switch 26 that is made in the form of an end cap. The conductor 24 for the push control of electricity transmission is in the form of a special folded plate and is directly mounted to an inner side of the cap of the switch 26 with an end thereof extending to cover the battery set 25 and further extending to connect the rotation motor 22, whereby when the push-control switch 26 is depressed, the conductor 24 is caused to engage the battery set 25 to realize electrical transmission to the rotation motor 22, and with resilient returning realized by an internally arranged resilient element 27, when the depression is released, the electrical transmission is automatically cut off and rotation of the rotation motor 22 is stopped, so as to allow control of dispensing of a proper amount of powder as desired. According to the need of hand holding and controlling, the control switch can be alternatively set on a circumferential surface on an end section of the container 10 to provide the electrically-driven power cosmetics application device.

To dispense the powder cosmetics, the top end cap 17 is first removed and the brush hair confiner tube 15 that confines outside the brush 14 is forced downward to a top end of the hollow collar 16 to allow an outer top portion of the brush 14 to automatically flare outward as an umbrella and thus allowing the powder cosmetics to pass through the powder outlet passage 13 and uniformly spread. By depressing the switch 26 then to conduct electricity, the internally arranged rotation motor 22 is actuated for rotation and makes the weight block 23 to carry out eccentric rotation. Due to the gravity unbalanced rotation, when put in high speed rotation, the container 10 shows successive vibration effect. By means of the minute successive vibration caused by the high speed rotation, the powder cosmetics filled inside the container 10 is driven through the filter 12 and is discharged through the powder outlet passage 13 to the lower portion of the brush 14 and is subjected to wiping of the brush hair to eventually realize such a control operation of uniform and electrically driven powder application. To finish the makeup operation, the switch 26 is operated to cut off electricity and stop the vibration induced powder supply operation, by which the supply of the powder is gradually reduced and even completely cut off whereby after the residual powder in the brush 14 is consumed up for final and complete makeup, the brush hair confiner tube 15 is pushed outward to confine the brush 14 for safely storing the brush hair. By confining the brush 14 together, leaking of the powder can be further assured, which together with the sealing provided by the top end cap 17, ensures cleanness and safety in storing the container 10.

The present invention employs a rotation motor 22 to effect eccentric driving of the weight block 23 for serving as an auxiliary measure that facilitates dispensing of powder from the container 10 through application of electricity to induce vibration and the regular and successive vibration so caused can make the dispensing of the filled powder cosmetics more smoothly so that assistance for continuous supply of powder cosmetics can be realized in applying the powder for make up purposes and the use of the powder cosmetics is made more smooth and the supply thereof continuous and uniform to effectively meet the need of make up operation. The whole process of controlling the electrically driven supply of powder cosmetics is reliable and is complete and continuous, providing a practical, precise, and economic structure of improvement. In view of the structure and design for supply and application of powder cosmetics, the electrically induced vibration provided by the present invention is of a novel structure and is practical and is an innovated design in view of the conventional devices of the kind.

To conclude, the present invention provides an electrically driven powder cosmetics application device, wherein a powder cosmetics container has an end forming a powder dispensing port, which, in combination with a brush and a brush hair confiner tube, allows the powder to be dispensed in a uniform and easy to use manner. Inside the bottom of the container, a rotation motor for rotation and control of an eccentric weight block is provided and is controlled to perform rotation through actuation of a push-control switch for timely transmission of electrical power to induce continuous vibration, whereby the powder cosmetics can be assisted by the continuous vibration for dispensing to ease the operation of make up and the smooth dispensing of the powder makes the operation of make up simple and easy in uniform application thereof. The enhancement of the practical effectiveness in smooth and continuous dispensing of powder cosmetics in the respect of cosmetics application is actually a complete novel design over the known devices.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. An electrically-driven powder cosmetics application device, comprising a container adapted to receive powder cosmetics, a brush for powder application and brushing operation, and an outer top cap, characterized in that the container has an end reduced to form a powder outlet port that is made in an extended tubular form fit into an end opening of the container and contains therein a filter and has a central portion forming a powder outlet passage extending to an end opening and a circumferential portion to which a brush is mounted and is circumferentially fit over by a slidable brush hair confiner tube for confining the brush for storage, the brush hair confiner tube having an outer circumference over which a hollow collar is fit to carry out sliding based position control operation and being covered and sealed by a top end cap set at the outside, an opposite end of the container forming a cavity to receive a separate electrics holder therein, the holder containing therein a rotation motor and a weight block mounted to an end of a spindle of the motor, a battery set being arranged outside the cavity, the motor being connected by an electrical wire or a conductor to a push-control switch set at an end of the container for controlling electricity transmission to the motor for operating the motor, the weight block inducing an unbalanced gravity that causes non-uniform rotation leading to vibration so as to realize assistance of electrically driven supply of the powder cosmetics from the container.

2. The electrically-driven powder cosmetics application device according to claim 1, wherein the filter is composed of sponges having pores of 2-3 mm diameter.

3. The electrically-driven powder cosmetics application device according to claim 1, wherein the weight block mounted to the spindle of the motor is arranged as an eccentric flywheel.

4. The electrically-driven powder cosmetics application device according to claim 1, wherein the container has a diameter of 16-32 mm.

5. The electrically-driven powder cosmetics application device according to claim 1, wherein the switch set is arranged on a circumferential surface of an end section of the container.

* * * * *